US007887052B2

(12) United States Patent
Krasuski

(10) Patent No.: US 7,887,052 B2
(45) Date of Patent: Feb. 15, 2011

(54) MAILPIECE FEED DEVICE HAVING AN INTEGRATED IMAGE SENSOR

(75) Inventor: Marek Krasuski, Fontenay aux Roses (FR)

(73) Assignee: Neopost Technologies, Bagneux (FR)

( * ) Notice: Subject to any disclaimer, the term of this patent is extended or adjusted under 35 U.S.C. 154(b) by 224 days.

(21) Appl. No.: 12/199,961

(22) Filed: Aug. 28, 2008

(65) Prior Publication Data

US 2009/0057979 A1 Mar. 5, 2009

(30) Foreign Application Priority Data

Aug. 31, 2007 (FR) ..... 07 57285

(51) Int. Cl.
*B65H 5/02* (2006.01)

(52) U.S. Cl. ..... 271/272; 271/2; 271/273

(58) Field of Classification Search ..... 271/2, 271/273, 272

See application file for complete search history.

(56) References Cited

U.S. PATENT DOCUMENTS

| | | | | |
|---|---|---|---|---|
| 4,558,373 | A * | 12/1985 | Plasencia et al. | 358/484 |
| 4,784,359 | A * | 11/1988 | Westover | 248/274.1 |
| 4,821,049 | A | 4/1989 | Eckl | |
| 4,886,596 | A | 12/1989 | Sasage et al. | |
| 5,171,980 | A * | 12/1992 | Marzullo et al. | 250/223 R |
| 5,203,217 | A * | 4/1993 | Buckley | 74/500.5 |
| 5,550,650 | A * | 8/1996 | Pan | 358/474 |
| 5,876,030 | A * | 3/1999 | Dobbertin et al. | 271/13 |
| 5,953,985 | A * | 9/1999 | Kobayashi | 101/116 |
| 6,105,954 | A * | 8/2000 | Magee et al. | 271/10.03 |
| 6,328,300 | B1 * | 12/2001 | Stefan et al. | 271/2 |
| 6,854,843 | B2 * | 2/2005 | Anami et al. | 347/104 |
| 6,905,661 | B2 * | 6/2005 | Ryan et al. | 422/300 |
| 7,355,763 | B2 * | 4/2008 | Furihata | 358/474 |
| 2003/0055795 | A1 | 3/2003 | Sesek | |
| 2003/0138129 | A1 | 7/2003 | Olson et al. | |
| 2004/0218230 | A1 * | 11/2004 | Furihata | 358/474 |
| 2005/0212196 | A1 * | 9/2005 | Dobbertin et al. | 271/145 |
| 2006/0033262 | A1 * | 2/2006 | Stemmle | 271/258.01 |
| 2007/0081212 | A1 * | 4/2007 | Tonami et al. | 359/197 |
| 2007/0228640 | A1 * | 10/2007 | Ikeda | 271/98 |
| 2009/0177312 | A1 * | 7/2009 | Audeon | 700/213 |
| 2010/0085612 | A1 * | 4/2010 | Audeon et al. | 358/474 |
| 2010/0091346 | A1 * | 4/2010 | Audeon et al. | 358/498 |

FOREIGN PATENT DOCUMENTS

EP 0 906 792 A2 4/1999

* cited by examiner

*Primary Examiner*—Stefanos Karmis
*Assistant Examiner*—Howard Sanders
(74) *Attorney, Agent, or Firm*—Sughrue Mion, PLLC

(57) ABSTRACT

In a mailpiece feed device comprising a mailpiece-receiving deck for receiving a stack of mailpieces for printing, selector means for extracting the mailpieces for printing one-by-one from said stack, and superposed conveyor rollers including movable upper rollers for conveying downstream the mailpieces extracted one-by-one in this way, there are further provided movable optical read means that are placed downstream from said selector means and that move synchronously with said movable upper conveyor rollers for conveying the mailpieces, so that, in cooperation with processor means, said optical read means scan and recognize automatically the data printed on said mailpieces.

7 Claims, 5 Drawing Sheets

MAILPIECE FEED DEVICE HAVING AN INTEGRATED IMAGE SENSOR

TECHNICAL FIELD

The present invention relates exclusively to the field of mail handling, and it relates more particularly to a mailpiece feed device having an integrated image sensor.

PRIOR ART

It is known that mailpieces associated with added-value services, such as express mail or registered/certified mail, use identification codes, of the bar code or equivalent type, in order to enable them to be tracked during the mail delivery process between the sender and the recipient. Such bar codes are printed either directly on the envelope, or else on a label that is then stuck to the envelope before being scanned prior to printing the postal imprint. Unfortunately, such scanning, which requires the mailpieces in question to be pre-sorted, is usually performed in the mail room by means of a handheld scanner and is therefore a lengthy and tedious task, in particular when the stack of mailpieces to be processed is large.

OBJECTS AND DEFINITION OF THE INVENTION

An object of the present invention is therefore to mitigate the above-mentioned drawbacks with an improved feed device making it possible for mailpieces to be processed automatically regardless of whether or not they are associated with added-value services. An object of the invention is also to propose a feed device that makes it possible, if necessary, for the data relating to such added-value services to be recorded automatically. Another object of the invention is to propose a feed device that does not need to have its general architecture redefined.

These objects are achieved by a mailpiece feed device comprising a mailpiece-receiving deck for receiving a stack of mailpieces for printing, selector means for extracting the mailpieces for printing one-by-one from said stack, and superposed conveyor rollers including movable upper rollers for conveying downstream the mailpieces extracted one-by-one in this way, wherein said mailpiece feed device further comprises movable optical read means that are placed downstream from said selector means and that move synchronously with said movable upper conveyor rollers for conveying the mailpieces, so that, in cooperation with processor means, said optical read means scan and recognize automatically the data printed on said mailpieces.

Thus, by means of this simple structure moving synchronously with the conveyor rollers, it is possible to adapt to accommodate any mailpiece thicknesses and to scan the mailpieces automatically while they are moving.

In a preferred embodiment, said movable optical read means comprise a linear sensor supported by at least one suspension arm that is caused to move synchronously with said movable upper rollers by means of a transverse support pin that is secured to said movable upper rollers, and against which said suspension arms come to rest.

Preferably, said linear sensor is mounted between an upstream deflector and a downstream deflector and is fastened to said deflectors via two side cheek plates, said at least one suspension arm being hinged at a first end to a pivot pin secured to said upstream deflector and at a second end to a common transverse hinge pin secured to the frame of said feed device.

Advantageously, said upstream deflector has a front edge that is inclined so as to enable said deflector to rise gently onto the mail piece, and said downstream deflector has a heel for reducing the angle of inclination of said sensor while said deflector is rising onto the mailpiece.

The mailpiece feed device of the invention may further comprise two bridges, each of which passes over said linear sensor and comes to be fastened via tabs to said upstream and downstream deflectors, the top face of each of said bridges being designed to receive a spring bearing against said frame, in such a manner as to guarantee that said linear sensor remains constantly in contact with the top surfaces of the mailpieces. Said tabs may also hold said pivot pins in recesses in said upstream deflector.

Advantageously, each of said upstream and downstream deflectors is provided with an opening in order to enable said movable upper rollers to pass through.

Said linear sensor is a Contact Image Sensor (CIS) formed of an integrated module comprising adjacent semiconductor detector cells, collimation optics, and a lighting system.

BRIEF DESCRIPTION OF THE DRAWINGS

The invention can be better understood on reading the following detailed description of non-limiting illustrative examples given with reference to the following figures, in which.

DETAILED DESCRIPTION OF EMBODIMENTS

Figure 4:
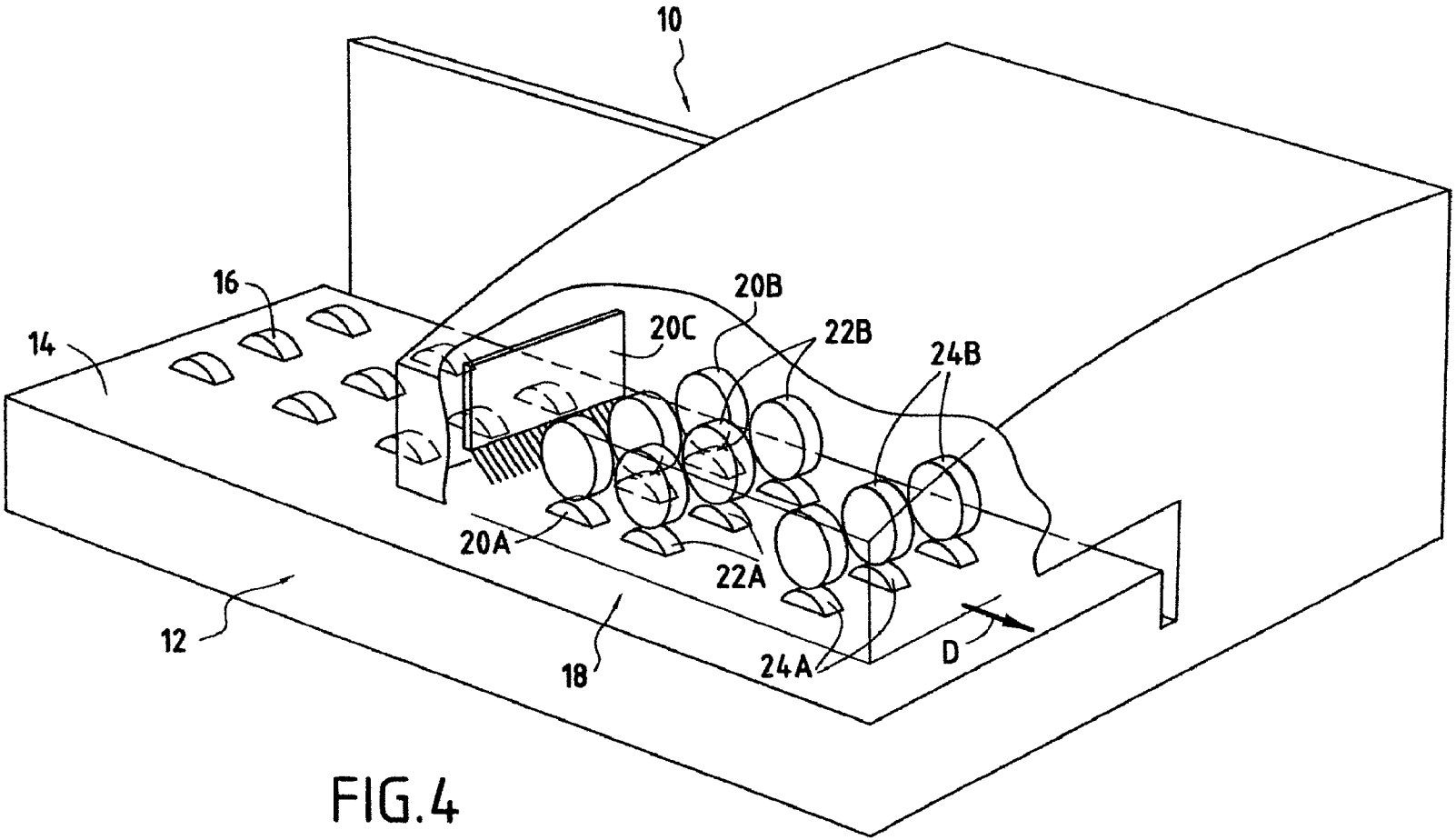
FIG. 4 PRIOR ART
FIG. 4 is a view of a prior art feed device.

As shown in FIG. 4, a mailpiece feed device 10 conventionally comprises, from upstream to downstream (relative to the advance direction D of the mailpieces through the device), a feed zone 12 essentially formed of a mailpiece-receiving deck 14 which is designed to receive a stack of mailpieces that are preferably of different formats, and which is optionally provided with first conveyor rollers 16 for driving the mailpieces downstream to the inlet of a separator and conveyer zone 18 comprising firstly a selector module formed of superposed extractor rollers 20A, 20B preceded by a guide 20C and in which said mailpieces are extracted automatically one-by-one from the stack, and secondly second conveyor rollers formed, for example, of two adjacent sets of superposed front conveyor rollers 22A, 22B and back conveyor rollers 24A, 24B for conveying the mailpieces extracted one-by-one in this way downstream from the feed device, e.g. towards a weigh module, or towards a print module of a franking machine or "postage meter" to which the feed device is connected. As is known, the upper rollers 22B, 24B of said conveyor rollers are mounted to be free to rotate and to move vertically so as to adapt to accommodate the various thicknesses of the mailpieces, and the lower rollers are motor-driven.

The feed device further comprises various monitoring and control means necessary for it to operate (in particular for actuating the various rollers necessary for driving the mailpieces through the device in the advance direction D) that are known and that it is therefore unnecessary to describe in any further detail.

Figure 1:
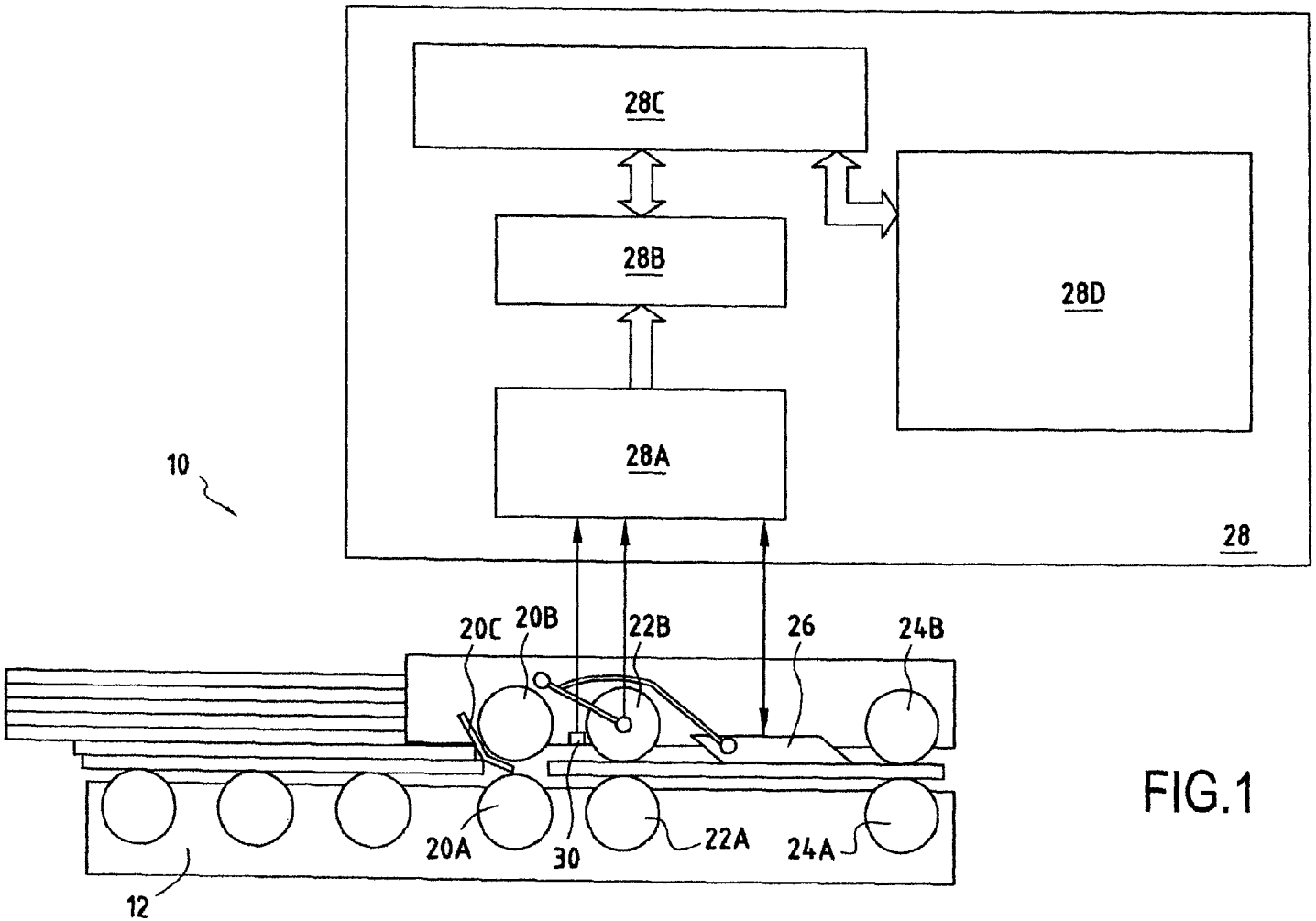
FIG. 1 is a diagrammatic view of a mailpiece feed device of the invention.

In accordance with the invention, and as shown diagrammatically in FIG. 1, in order to enable mailpieces associated with added-value services and present in the stack of mailpieces on the mailpiece-receiving deck to be processed automatically, the invention proposes to integrate into this conventional feed device movable optical read means 26 that, acting in co-operation with processor means 28, make it possible to scan and to perform automatic recognition of the services associated with such mailpieces once they have been selected by the corresponding selector module. This assembly is mounted to move synchronously with at least one of the movable conveyor rollers 22B so as to guarantee that the mailpieces are processed regardless of their thicknesses, in particular in the presence of thick envelopes, and is compact enough not to require the overall configuration of the feed device to be modified, and in particular its overall external size. Scanning by the processor means 28 is advantageously synchronized on the basis of pulses from an encoder 22Ba mounted on the movable conveyor roller 22B and of a detector 30 for detecting an edge of each of the mailpieces.

Figure 2:
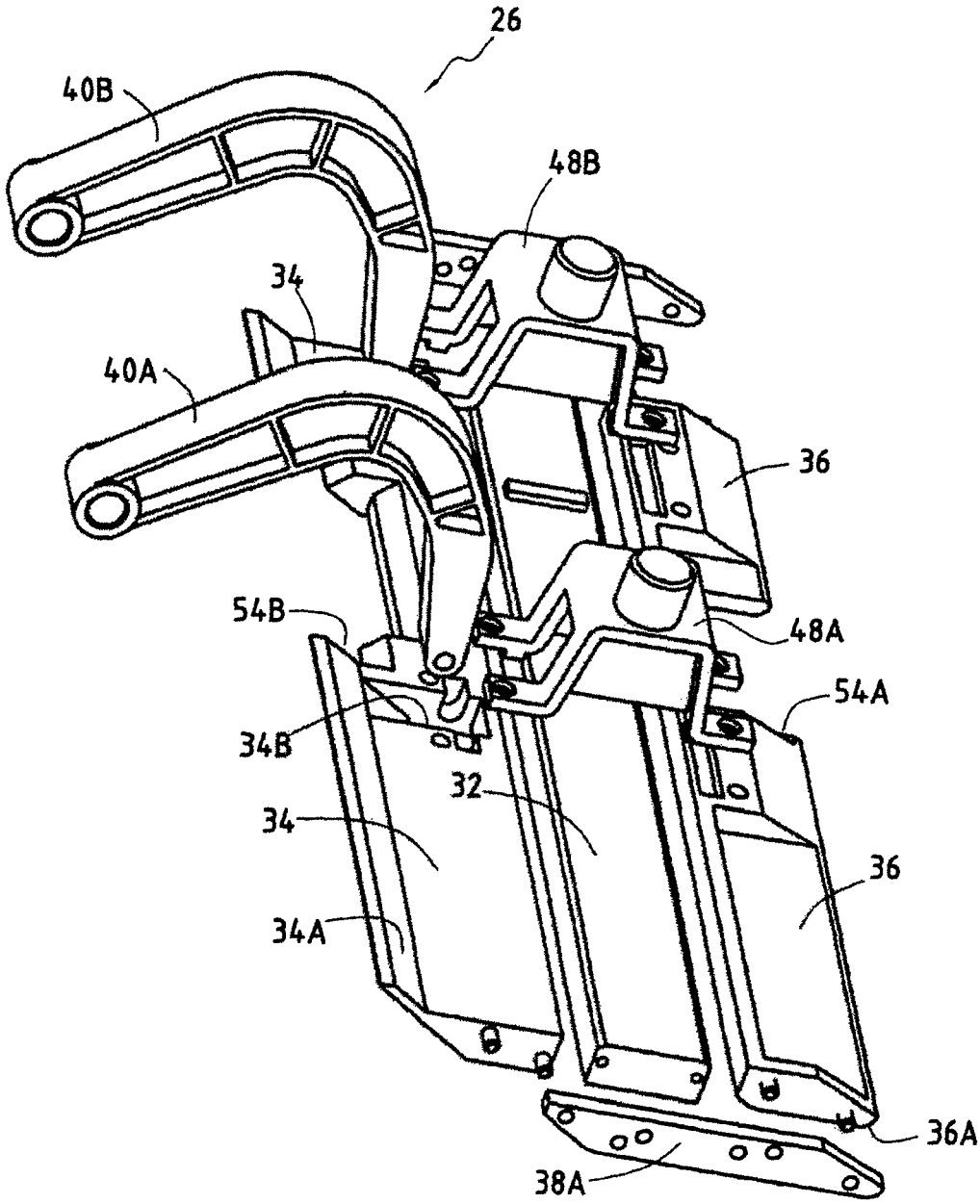
FIG. 2 is a perspective view of movable optical read means deigned to be integrated into the feed device of FIG. 1.
Figure 3A:
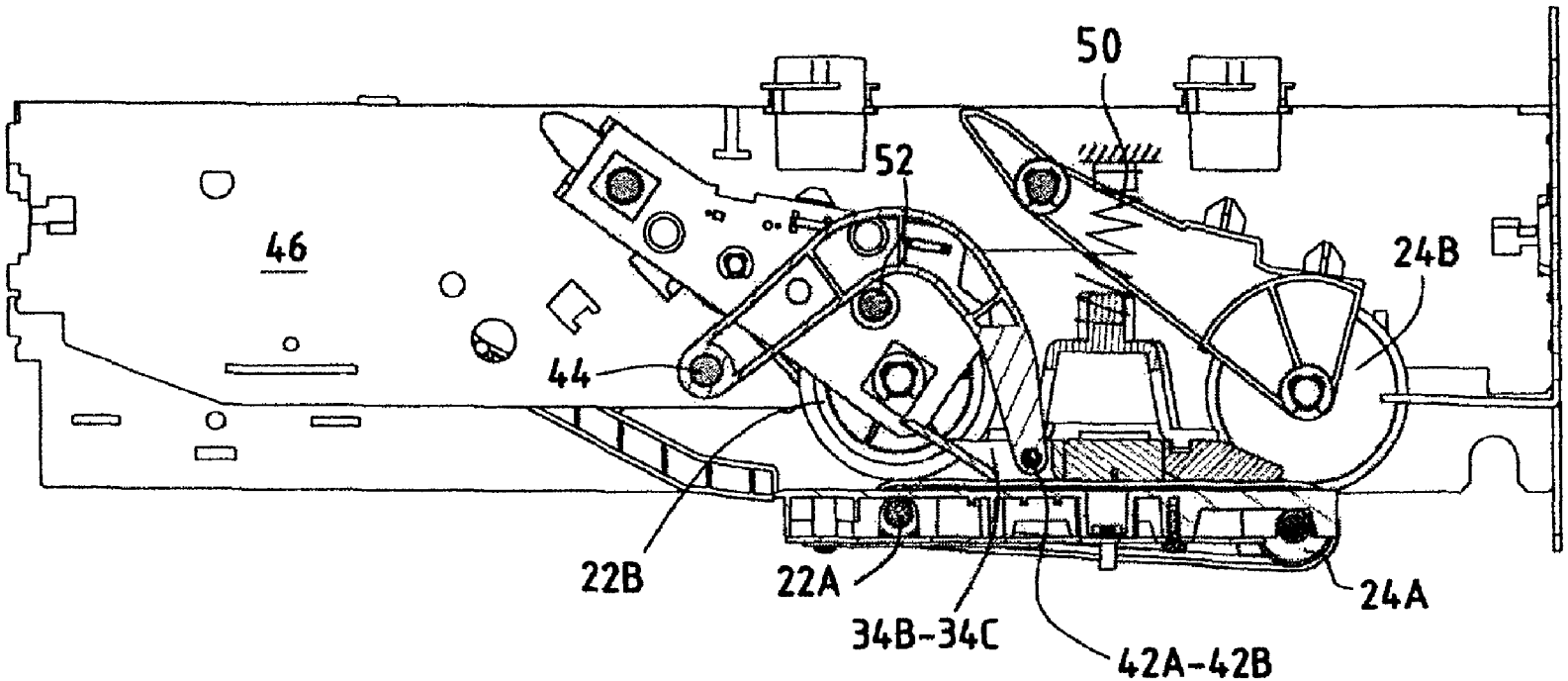
FIGS. 3A to 3C are section views of a portion of the feed device of the invention with the movable optical read means of FIG. 1 being shown in three successive positions.

The perspective view of FIG. 2 shows more precisely the movable optical read means 26 comprising a sensor 32 mounted between an upstream deflector 34 and a downstream deflector 36, and fastened to said deflectors by two side cheek plates 38A, 38B. The bottom surfaces of the sensor and the bottom surfaces of the deflectors thus being held exactly in alignment so as to guarantee plane contact with the top surfaces of the mailpieces. The upstream deflector has a front edge 34A that is inclined so as to enable the optical read means to rise gently onto the mailpiece, in particular a mailpiece of large thickness, and the downstream deflector has a heel 36A that, by bearing against the conveyor table, makes it possible to reduce the angle of inclination of the sensor while the optical read means are rising onto the mailpiece. The assembly comprising the sensor and the deflectors is supported by two suspension arms 40A, 40B having bends and hinged at first ends to pivot pins 42A, 42B that are advantageously fixed in recesses 34B, 34C in the upstream deflector, and at second ends to a common transverse hinge pin 44 whose ends are fastened to longitudinal walls 46 disposed on either side of the conveyor path along which the mailpieces are conveyed and secured to the frame of the feed device (pins and cheek plates are shown in FIGS. 2 and 3). In order to guarantee that the sensor remains constantly in contact with the top surfaces of the mailpieces, two bridges 48A, 48B, each of which has a top face that is designed to receive one end of respective resilient presser means, e.g. a spring 50, (whose other end bears against the frame (see FIGS. 3A to 2C), pass over the sensor 32 and come to be fastened to the upstream deflector and to the downstream deflectors respectively via front tabs and via back tabs. The front tabs also serve to hold the pivot pins 42A, 42B of the sensor/deflector assembly in the recesses 34B, 34C of the upstream deflector.

In accordance with the invention, in order to reduce the impacts due to the mailpieces passing through, and in order to reduce the sensor jolts resulting from such impacts, the assembly comprising the sensor and the deflectors is moved synchronously with the front movable upper conveyor rollers so as to raise the sensor before the mailpieces pass through. This movement is obtained by a transverse support pin 52 that is secured to said movable upper rollers and on which the bottom edges of each suspension arm 40A, 40B come to rest. In its central portion, each of the suspension arms advantageously has an accentuated curved shape whose varying slope enables the assembly comprising the sensor and the deflectors to track the vertical movement of the rollers with a slight delay.

Finally, it should be noted that, in order not to increase the overall size of the feed device, each of the upstream and downstream deflectors is preferably provided with an opening 54A, 54B, the two openings being in register with each other, for the purpose of enabling the front and back movable upper mailpiece conveyor rollers 22B and 24B to pass through, between which rollers the movable optical read means 26 is disposed transversely to the advance direction D of the mailpieces.

The sensor is advantageously a Contact Image Sensor (CIS) of the linear type whose length is designed to scan at least the width of a mailpiece that covers the postal imprint and the recipient address. The linear optical sensor is typically an integrated module having adjacent semiconductor Charge Coupled Device (CCD) or Complementary Metal Oxide Semiconductor (CMOS) detector cells, collimation optics, and a lighting system. When it is activated, said module lights the surface on which the sensor is positioned and delivers, in return, at each of the detector cells, a signal proportional to the light reflected by the surface of the mailpiece.

Figure 3B:
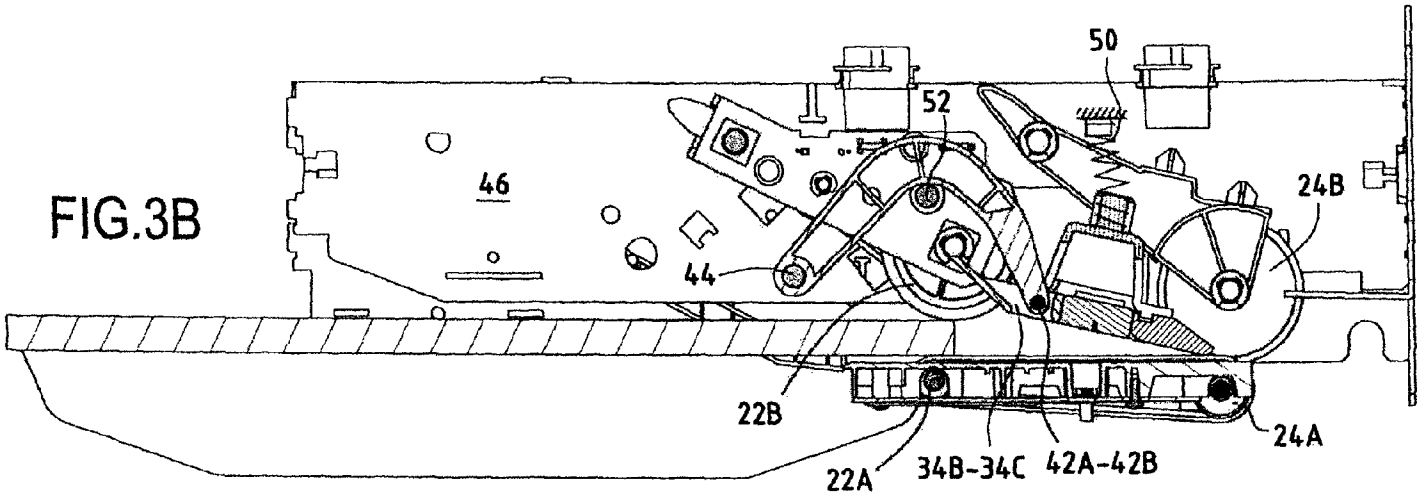
Figure 3C:
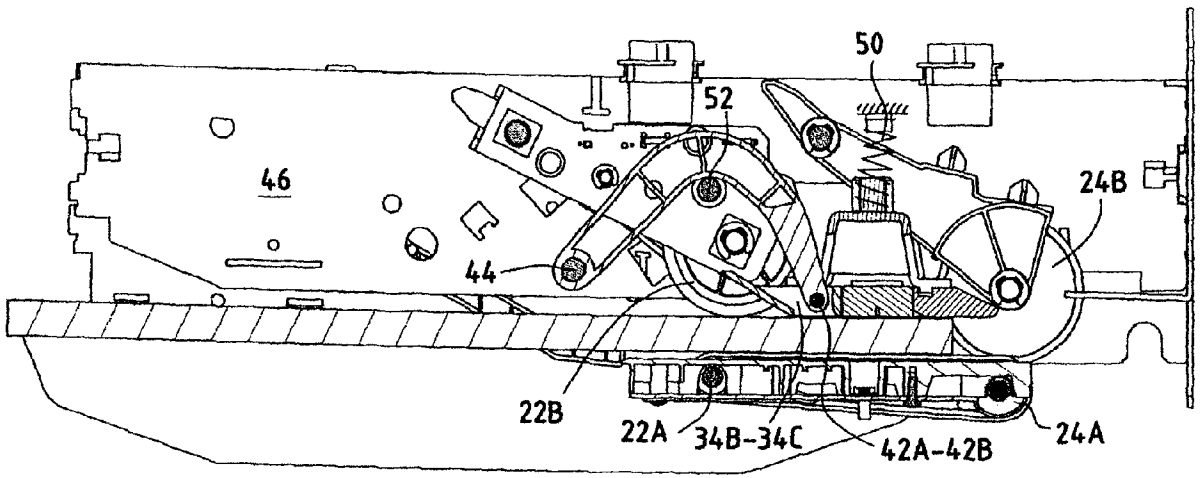

Operation of the feed device is described below with reference to FIGS. 3A to 3C that show the movable optical read means when a mailpiece is in respective ones of three successive advance positions. In FIG. 3A, the movable optical read means 26 are at rest, the sensor resting flat on the table for conveying the mailpieces, and the front and back upper conveyor rollers 22B, 24B also resting on said conveyor table, the transverse support pin 52 of these rollers being in contact with the suspension arms 40A, 40B. In FIG. 3B, the mail item has been selected upstream by the selector module and is in engagement with the front conveyor rollers 24A, 24B. By moving vertically, the front upper conveyor rollers 22B entrain upwards the transverse support pin 52 to which they are secured, which support pin in turn raises the suspension arms 40A, 40B so that the assembly comprising the sensor and the deflectors is inclined while resting on the heel 36A of the downstream deflector, and so that the inclined front edge 34A finds itself substantially at an angle of about 400. In FIG. 3C, the mailpiece has moved downstream while fully raising the assembly comprising the sensor and the deflectors. Merely by pivoting about the pivot pins 42A, 42B, said assembly has become entirely horizontal again and it is held in contact with the top surface of the mailpiece by means of the spring 50. In this fully stable position, it is possible to acquire an image of the surface of the mailpiece line-after-line.

As shown in FIG. 1, this acquisition is performed on the basis of a starting signal delivered by the detector 30 for detecting the edge of the mailpiece, and as a function of the advance of said mailpiece as detected by the encoder secured to one of the movable upper rollers, so as to deliver successively, under the control of the processor means 28, a control signal and read signals for reading the intensity levels of the detector cells, the frequency of the control signals depending on the desired read resolution. The signals collected by the processor means can be analog or digital, depending on the nature of the sensor, and, if necessary, they are therefore scanned and standardized at a programmable circuit constituted by a Field-Programmable Gate Array (FPGA) 28A before being stored in a Random Access Memory (RAM) 28B of the feed device, in which memory the image of the mailpiece is reconstructed. By digitally processing the image in a microprocessor 28C, it is then possible, depending on the application implemented and available in a programs Read-Only Memory 28D, to interpret the image, i.e. to perform Optical Character Recognition (OCR) on the address and, when bar codes are present on the mailpiece, to perform bar code recognition. Recognition of this address or bar code data printed on the mailpieces makes it possible, as is known, on the basis of said data as sent to the franking machine and of the postal data input by the operator into the franking machine, to create a database for addresses and for tracking of the mailpieces.

It should be noted that, by integrating the movable optical read means immediately after the selector module, i.e. well upstream of the print module of the franking machine, the processor means have enough time to perform said recognition of the data and, in this way, processing of the mailpieces is not slowed down.

What is claimed is:

1. A mailpiece feed device comprising a mailpiece-receiving deck for receiving a stack of mailpieces for printing, selector means for extracting the mailpieces for printing one-by-one from said stack, and superposed conveyor rollers including movable upper rollers for conveying downstream the mailpieces extracted one-by-one in this way, wherein said mailpiece feed device further comprises movable optical read means that are placed downstream from said selector means and that move synchronously with said movable upper conveyor rollers for conveying the mailpieces, so that, in cooperation with processor means, said optical read means scan and recognize automatically the data printed on said mailpieces;

wherein said movable optical read means comprise a linear sensor supported by at least one suspension arm that is caused to move synchronously with said movable upper rollers by means of a transverse support pin that is secured to said movable upper rollers, and against which said suspension arms come to rest; and wherein said linear sensor is mounted between an upstream deflector and a downstream deflector and is fastened to said deflectors via two side cheek plates, said at least one suspension arm being hinged at a first end to a pivot pin secured to said upstream deflector and at a second end to a common transverse hinge pin secured to the frame of said feed device.

2. A mailpiece feed device according to claim 1, wherein said upstream deflector has a front edge that is inclined so as to enable said deflector to rise gently onto the mail piece, and said downstream deflector has a heel for reducing the angle of inclination of said sensor while said deflector is rising onto the mailpiece.

3. A mailpiece feed device according to claim 1, further comprising two bridges, each of which passes over said linear sensor and comes to be fastened via tabs to said upstream and downstream deflectors, the top face of each of said bridges being designed to receive a spring bearing against said frame, in such a manner as to guarantee that said linear sensor remains constantly in contact with the top surfaces of the mailpieces.

4. A mailpieces feed device according to claim 3, wherein said tabs also hold said pivot pins in recesses in said upstream deflector.

5. A mailpiece feed device according to claim 1, wherein each of said upstream and downstream deflectors is provided with an opening in order to enable said movable upper rollers to pass through.

6. A mailpiece feed device according claim 1, wherein said linear sensor is a contact image sensor formed of an integrated module comprising adjacent semiconductor detector cells, collimation optics, and a lighting system.

7. A mail-handling machine including a mailpiece feed device according to claim 1.

* * * * *